US006908259B1

(12) United States Patent
Tomlinson

(10) Patent No.: US 6,908,259 B1
(45) Date of Patent: Jun. 21, 2005

(54) METHOD AND APPARATUS FOR REMOTELY SEVERING A PREFABRICATED VERTICAL DRAIN

(75) Inventor: Garey I. Tomlinson, Sooke (CA)

(73) Assignee: Nilex Construction, LLC., Centennial, CO (US)

( * ) Notice: Subject to any disclaimer, the term of this patent is extended or adjusted under 35 U.S.C. 154(b) by 0 days.

(21) Appl. No.: 10/749,002

(22) Filed: Dec. 29, 2003

(51) Int. Cl.[7] ..... E02B 11/00
(52) U.S. Cl. ..... 405/36; 405/45
(58) Field of Search ..... 405/36, 43, 45, 405/46, 50

(56) References Cited

U.S. PATENT DOCUMENTS 4,428,699 A * 1/1984 Juhola ..... 405/50
4,455,105 A * 6/1984 Juhola ..... 405/50
4,537,527 A * 8/1985 Juhola et al. ..... 405/50
5,213,449 A 5/1993 Morris ..... 405/232
6,655,873 B2 * 12/2003 Bodegom ..... 405/174

* cited by examiner

*Primary Examiner*—Robert E. Pezzuto
*Assistant Examiner*—Tara L. Mayo
(74) *Attorney, Agent, or Firm*—Carothers & Carothers

(57) ABSTRACT

Vertical prefabricated drains are installed into soil underlying a body of water for soil stabilization and thereafter from the surface of the water the drain member is captured within a drain cutting assembly which is lowered by an operating line that is tethered to the assembly into the water as guided by the captured drain. Then the prefabricated drain is severed below the surface of the water by actuating the cutter assembly at the water surface with the operating line.

1 Claim, 4 Drawing Sheets

METHOD AND APPARATUS FOR REMOTELY SEVERING A PREFABRICATED VERTICAL DRAIN

BACKGROUND OF THE INVENTION

This invention relates generally to the insertion of vertical prefabricated drains into the earth, and more specifically to a method and apparatus for remotely severing such drains after installation under a body of water.

One well known technique for improving soft, saturated soil, such as saturated clay for example, is to drive into the soil a drainage element (a prefabricated vertical drain or PV drain) that penetrates deep into the soil with the top end of the drainage element maintained above the surface of the soil. The PV drain is formed of a suitable material which is water permeable so the water in the soil can penetrate the walls of the drain and flow upwardly therein, to the surface of the soil as a result of water pressures in the soil beneath the surface. It is common practice in such situations to increase the inherent water pressures in the soil by placing a layer of earth on top of the wet soil so that the weight thereof will assist in forcing the water into and upwardly through the PV drains, where it can be readily disbursed.

The PV drains are composite drains composed of an extruded plastic core shaped to provide drainage channels when this core is wrapped in a special filter fabric generally referred to as geofabric. The geofabric is a filter fabric constructed with opening sizes such as to prevent the entrance of soil particles, but allow pore water to enter freely. The finished drain material is band-shaped, is about ⅛ to ¼ inches thick, and approximately 4 inches wide. It is provided in 4 to 5-foot diameter rolls containing 800 to 1000 feet of drain. An example manufacturer of PV drains is Nilex Construction, LLC of Centennial, Colo., U.S.A. Its product is sold under the trademark MEBRADRAIN.

Installation is accomplished by means of specialized equipment, consisting of a crane (or excavator) mounted with a mast housing a special installation mandrel. The mandrel, containing the drain, is intruded directly into the ground from the bottom of the mast. After reaching the desired depth, the mandrel is withdrawn back into the mast, leaving the undamaged drain in place within the soil. A typical installation rig may utilize roller chains to drive the mandrel, however there are a number of methods of driving the mandrel, including cables activated by rotary winches as well as linear hydraulic rams. Some units make use of rack and pinion arrangements where the rack portion is attached to the mandrel and the drive (or pinion) linkage is at the bottom of the mast. A vibratory hammer is sometimes attached to the top of the mandrel to aid in penetrating stiff or hard layers within the soil. By way of example see U.S. Pat. No. 5,213,449 for Apparatus for Inserting Wick Drains into the Earth.

FIG. 1 illustrates one typical anchor plate configuration 1. After the drain 10 is attached to the bail or handle 11 of the anchor plate 12 as indicated, the drain is pulled back manually by back spooling onto the PV drain reel, so that the anchor plate completely and firmly covers the bottom end 13 of the mandrel 14. This prevents soft soil from entering the mandrel as it is penetrated into the earth. It then acts as an anchor, holding the drain in place as the mandrel is withdrawn.

After the mandrel is withdrawn, the drain between the bottom of the mandrel and the ground is manually cut, another anchor plate is attached to the drain and the drain pulled back to again seat the anchor plate over the mandrel bottom. The rig is then moved to the next drain location, and the process is repeated.

When constructing marine earthworks (breakwaters, jetties, cofferdams, etc.) it is often desirable to install PV drains into the soil below the body of water to accelerate the consolidation of underlying soft, compressible soil on which the works are to be built. After the drains are installed it is usual practice to place a layer of stone over the drains and then build the fill or work over the stone. The stone acts as a drainage medium, allowing pore water exiting the drains to find a free drainage path from under the fill.

In these cases PV drains are often installed from a barge as illustrated in FIG. 2. The sequence of installation is essentially the same as a land operation. FIG. 2 illustrates the condition where the drain 10 has just been installed and the mandrel has been withdrawn to above water level. It would be desirable to cut the drain near to the sea bottom, but since this operation may take place in water depths up to 60 feet this is problematic.

Present practice is to cut the drains above the water level, and either leave the resulting excess drain or to weight the top end of the drain and let it sink to the bottom. In either case much drain material is wasted, and the excess drain left in the water poses a nuisance, if not a hazard. If it is essential that the excess drain material be removed it would require divers to cut the drains to length after installation.

The present invention discloses a novel method and apparatus to cut the drains near to the bottom of the body of water while working entirely from the barge.

SUMMARY OF THE INVENTION

With the method of the present invention a prefabricated vertical drain is installed into soil underlying a body of water by driving the prefabricated drain downwardly into the soil underlying the body of water from the water surface. Then the drain is captured at the water surface within a drain cutting assembly. The drain cutting assembly is tethered to an operating line and the assembly is lowered with the line into the water as guided by the captured drain. Thereafter the drain is severed below the surface of the water by actuating the cutting assembly at or adjacent the water surface with the operating line tethered to the assembly.

In its preferable configuration the drain cutting assembly of the present invention is comprised of a utility knife having a J-shaped handle with opposite terminating ends and a J saddle therebetween, and a cutting blade is retained in the saddle. A capture mechanism is secured to the terminating ends of this handle and is dimensioned and configured for providing side access of the drain into the capture mechanism wherein the drain is captured for guided edge engagement of the drain with the cutting blade for severing the drain when actuated. The operating line is tethered to this capture mechanism for remotely manipulating the assembly to sever the drain with the blade.

In a preferred embodiment, the capture mechanism is comprised of a U-shaped frame having parallel legs with distal ends thereof respectively secured to the terminating ends of the handle. A gap is provided in one of the legs which is dimensioned for admitting access of the drain into the frame and a capture bar is also provided which has opposite ends thereof slidably received respectively on the legs for sliding the bar towards the drain and the handle to capture the drain for guided severing by the blade. One of the leg slides of this capture bar is dimensioned and configured for closing the gap when the capture bar is fully slid toward the handle. The assembly may also include a tether arm that extends from the bracket with the operating line secured to the distal end of the arm.

BRIEF DESCRIPTION OF THE DRAWINGS

Other objects and advantages appear hereinafter in the following description and claims. The accompanying drawings show, for the purpose of exemplification, without limiting the invention or appended claims certain practical embodiments of the present invention wherein:

DETAILED DESCRIPTION OF A PREFERRED EMBODIMENT

Figure 3:
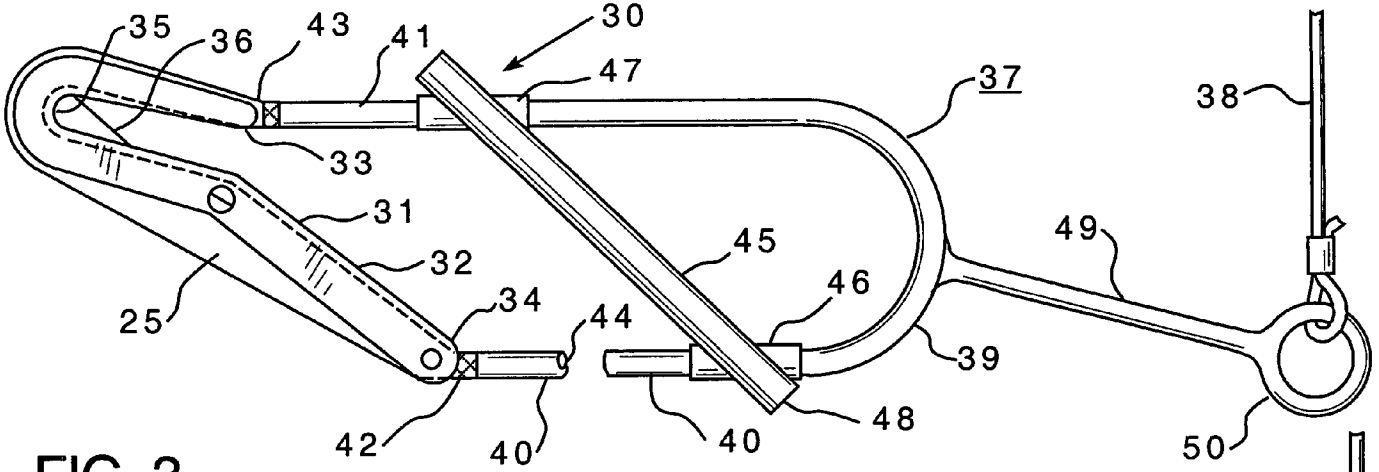
FIG. 3 is a plan view of the apparatus of the present invention for remotely severing prefabricated vertical drain.
Figure 4:
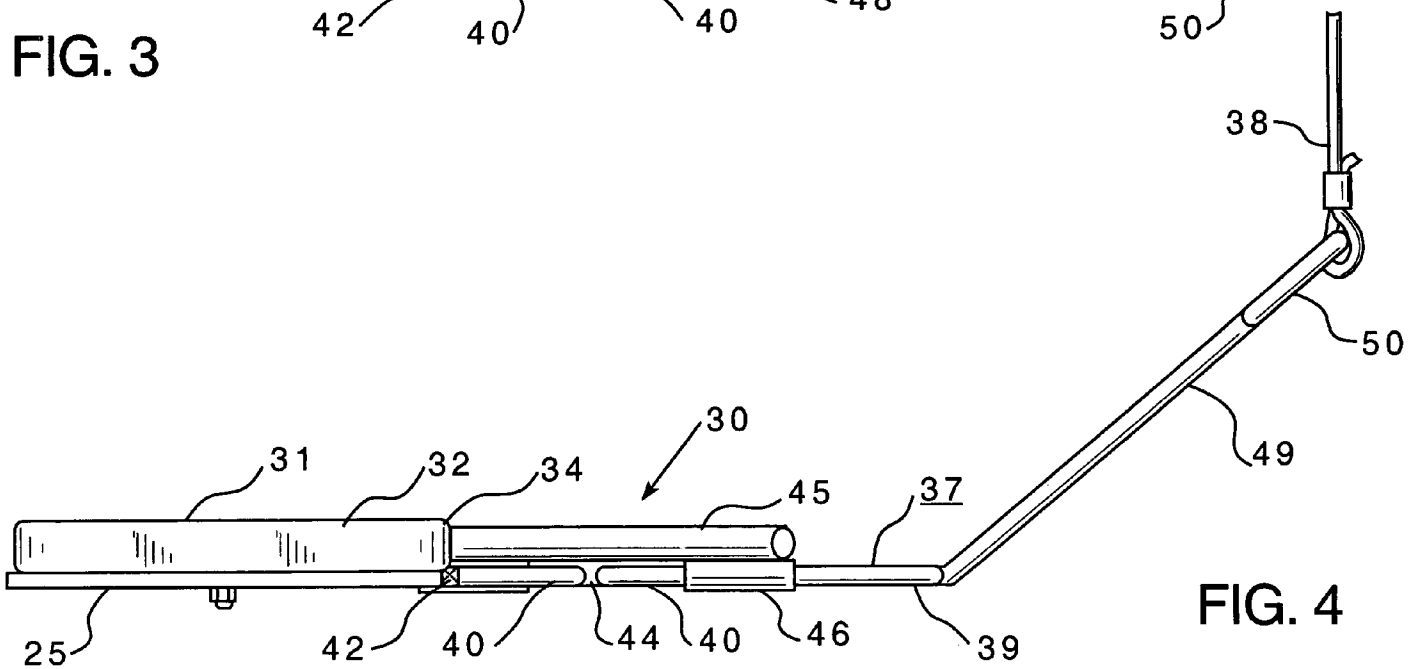
FIG. 4 is a view in front elevation of the apparatus shown in FIG. 3.
Figure 5:
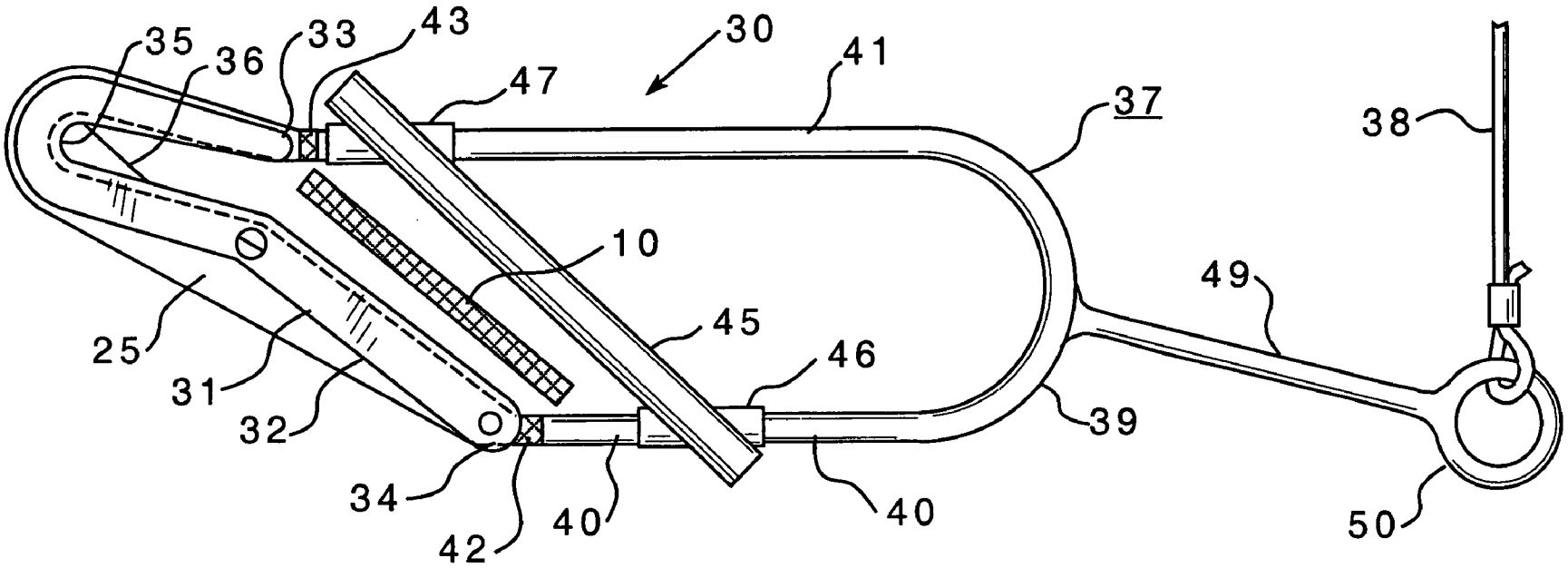
FIG. 5 is a plan view of the apparatus shown in FIGS. 3 and 4 in its closed position for capturing a prefabricated vertical drain therein.

Referring to FIGS. 3, 4 and 5, the drain cutting assembly 30 of the present invention is provided for remotely severing a vertical prefabricated drain 10 as shown in cross section in FIG. 5. A utility knife 31 makes up part of the assembly 30 and is a commercially available utility knife available from a number of manufacturers, such as from SAFETY-T-CUT, INC. of Palmer, Mass. The utility knife 31 has a J-shaped handle 32 with opposite terminating ends 33 and 34 and a J saddle 35 therebetween. A cutting blade 36 is retained in saddle 35.

A capture assembly 37 is secured to the terminating ends 33 and 34 of handle 32 and is dimensioned and configured for providing access there into of drain 10 as seen in FIG. 5 for capturing the drain 10 for guided edge engagement with blade 36 for severing drain 10. An operating line 38 is tethered to capturing assembly 37 for remotely manipulating the assembly to sever the drain 10 with the blade 36.

The capture assembly 37 is comprised of a U-shaped frame 39 having parallel legs 40 and 41 with distal ends 42 and 43 thereof respectively secured to terminating ends 34 and 33 of handle 32 via mounting plate 25, to which handle 32 is bolted. Gap 44 is provided in leg 40 of frame 39 for admitting side access of drain 10 into frame 39.

Capture bar 45 has opposite ends 46 and 47 slidably received respectively on legs 40 and 41 for sliding bar 45 toward captured drain 10 and handle 32 as illustrated in FIG. 5 to capture drain 10 for guided severing by the blade 36. When bar 45 is fully slid toward handle 32 of utility knife 31, as illustrated in FIG. 5, the leg slide 48 of bar end 46 is dimensioned and configured for closing the gap 44 and thereby preventing the escape of captured drain 10.

A tether arm 49 extends from frame 39 for securing operating line 38 at the distal end 50 of arm 49. This provides advantageous leverage for remote manipulation of line 38 in order to assist in guiding the edge of captured drain 10 into cutting blade 39 for severing the drain.

Figure 1:
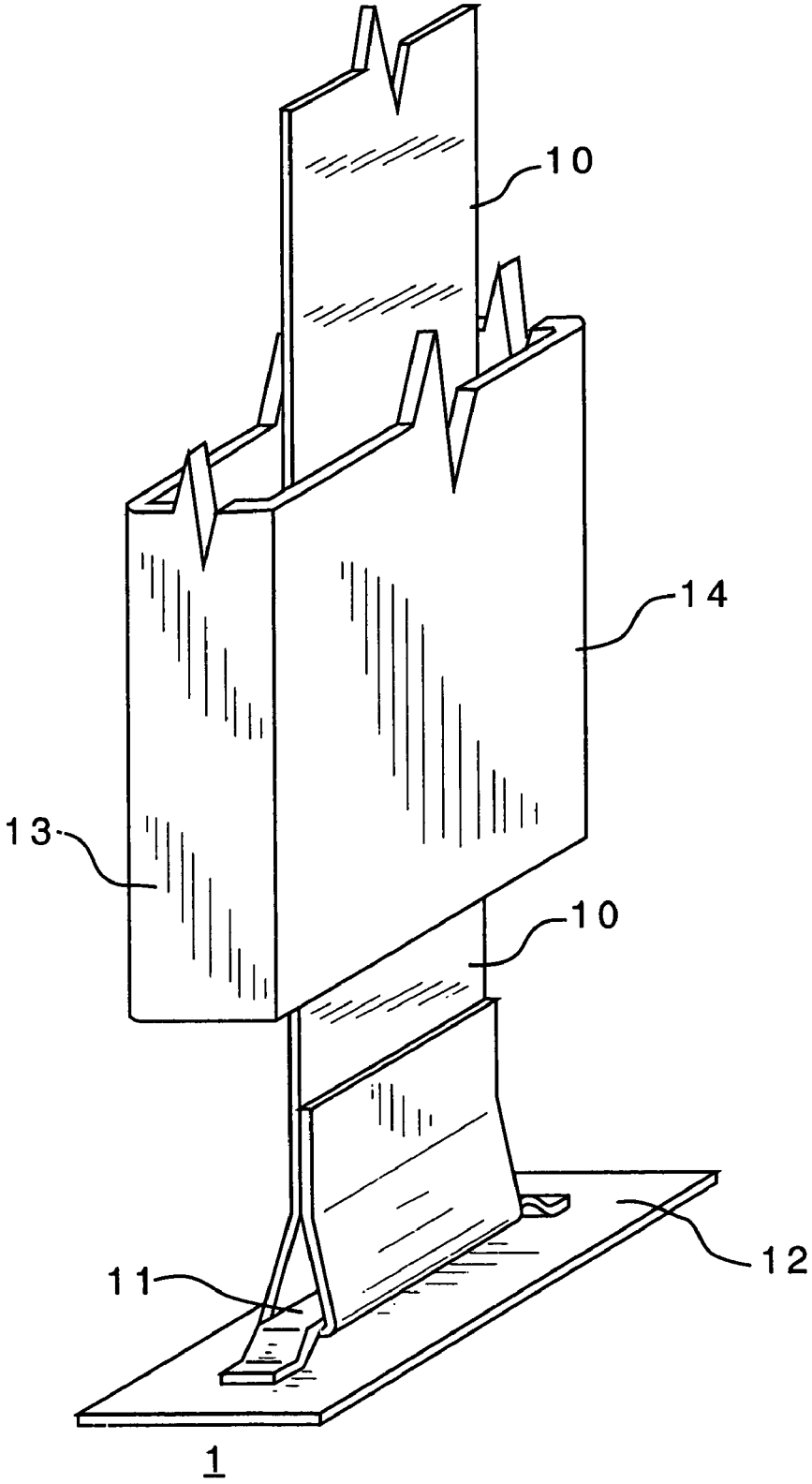
FIG. 1 Prior Art
FIG. 1 is an isometric view illustrating the bottom end of a prefabricated vertical drain as attached to an anchor plate utilized for closing off the bottom end of a mandrel.
Figure 2:
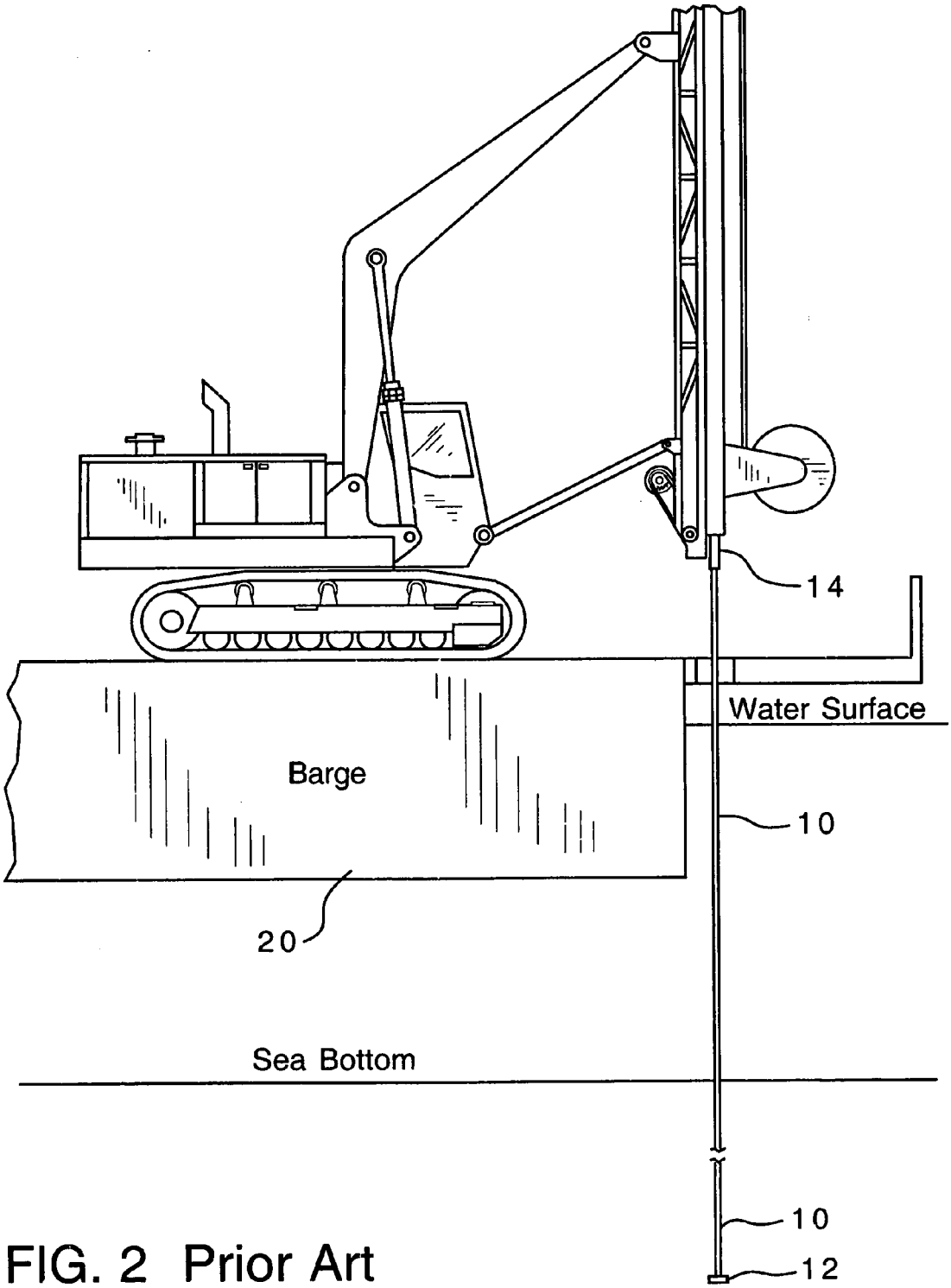
FIG. 2 Prior Art
FIG. 2 is a schematic view in elevation of apparatus for installing prefabricated vertical drains into earth underlying a body of water.

Thus, in accordance with the teachings of the method of the present invention, a prefabricated vertical drain 10 is installed into soil underlying a body of water as is envisioned in FIG. 2. This is accomplished by driving the prefabricated drain 10 downwardly within mandrel 14 into soil underlying the body of water from the water surface, usually, as illustrated, from a barge. After the drain has been installed and mandrel 14 withdrawn, the drain 10 is captured adjacent the water surface with the drain cutting assembly 30 of the present invention as aforedescribed and illustrated in FIG. 5. The cutting assembly 30 is then lowered with the line 38 into the water as guided by the captured drain 10.

Generally the cutting assembly 30 will be lowered until the bottom of the body of water is reached and then the drain 10 is severed below the surface of the water by actuating the cutting assembly 30 above the water surface by merely pulling upwardly to the side on the operating line 38 from the barge.

I claim:

1. The method of installing a prefabricated vertical drain into soil underlying a body of water comprising the steps of:

driving a prefabricated drain downwardly into soil underlying a body of water from the water surface with a surrounding mandrel, withdrawing the mandrel and thereby leaving the prefabricated drain exposed, capturing the exposed drain adjacent the water surface within a drain cutting assembly tethered to an operating line, lowering the cutting assembly with the line into the water as guided by the captured drain, and severing the drain below the surface of the water by actuating the cutting assembly adjacent the water surface with said line.

* * * * *